United States Patent [19]

Iemmi et al.

[11] 4,441,976

[45] Apr. 10, 1984

[54] DEVICE FOR ELECTROLYTIC SURFACE TREATMENT OF MECHANICAL WORKPIECES

[75] Inventors: Giuliano Iemmi; Michele Raimondo; Luigi Mo, all of Turin, Italy

[73] Assignee: Centro Ricerche Fiat S.p.A., Turin, Italy

[21] Appl. No.: 316,389

[22] Filed: Oct. 29, 1981

[30] Foreign Application Priority Data

Oct. 29, 1980 [IT] Italy ..... 68650 A/80

[51] Int. Cl.[3] ..... C25D 17/04; C25D 17/06; C25D 7/04

[52] U.S. Cl. ..... 204/224 M; 204/297 W; 204/275; 204/237; 204/272; 204/26; 204/224 R

[58] Field of Search ..... 204/224 R, 224 M, 225, 204/237, 275, 297 R, 272, 26

[56] References Cited

U.S. PATENT DOCUMENTS

| | | | |
|---|---|---|---|
| 3,226,308 | 12/1965 | Pochapsky et al. | 204/26 |
| 3,464,910 | 9/1969 | Krebs et al. | 204/272 |
| 3,499,830 | 4/1970 | Haggerty et al. | 204/224 M |
| 3,677,928 | 7/1972 | Fleury | 204/224 M |
| 3,746,632 | 7/1973 | Küdorf et al. | 204/212 |
| 3,841,990 | 10/1974 | Sasaki et al. | 204/224 R |
| 3,853,734 | 12/1974 | Ellis et al. | 204/275 |
| 3,857,772 | 12/1974 | Sasaki et al. | 204/224 R |
| 3,956,096 | 5/1976 | Paulson et al. | 204/272 |
| 4,137,143 | 1/1979 | Suslin et al. | 204/225 |

*Primary Examiner*—T. Tung
*Assistant Examiner*—Nathan S. Thane
*Attorney, Agent, or Firm*—Sughrue, Mion, Zinn, Macpeak and Seas

[57] ABSTRACT

A workpiece to be treated, for example, an engine cylinder, is held vertically with a liquid-tight seal in a treatment device including a head which is fixed in the working plane of a work bench, and a counterhead supported from the work bench by a bracket which can be raised hydraulically. The device is selectively connectible, through control valves and circulation pumps, to reservoirs containing different treatment liquids. The liquids enter the cylinder in an ascending flow through the head in such a way as to avoid swirling movements. Preferably, several treatment devices are arranged to work in synchronism.

7 Claims, 4 Drawing Figures

DEVICE FOR ELECTROLYTIC SURFACE TREATMENT OF MECHANICAL WORKPIECES

The present invention relates to a device for electrolytic surface treatment of mechanical workpieces of the type including a head and counter-head which can be applied in a liquid-tight manner against respective ends of a vertically-arranged workpiece, an anode arranged to extend along the axis of the workpiece in use, and means for circulating a liquid electrolyte around a closed circuit taking it through the interior of the workpiece, the circulation means including a reservoir spaced from the head and counter-head and a circulation pump.

A device of this type is known from GB No.-A-667227. Other devices for the electrolytic treatment of the internal surfaces of tubular or annular workpieces are also known, but in these the workpiece is immersed in an electrolyte which circulates entirely within a tank containing the electrolyte and the workpiece. The device according to GB No.-A-667227 has the advantage that the electrolyte circulates in a closed circuit isolated from the environment so that, among other things, the operator is not subjected to the risk of poisoning, burning or other accidents. Moreover, only the interior of the workpiece is wetted by the electrolyte so that the risk of contamination of the electrolyte is drastically reduced and, at the same time, the handling of the workpiece is considerably facilitated.

The device according to GB No.-A-667227 is not suitable, however, for high treatment rates. Moreover, in the manufacture of cylinders for small internal combustion engines (generally single-cylinder engines for mounting on mopeds or small motor cycles), for example, the problem of making the inner surface of the cylinder sufficiently wear-resistant involves the use of a succession of different electrolytes with intermediate washing treatments, and therefore requires different arrangements. In particular, according to modern techniques, a basic electrolyte for the aforesaid purpose is constituted by a very fine dispersion of silicon carbide (SiC) in a solution of nickel (Ni) compound, which provides a strongly wear-resistant electrolytic layer formed by a matrix of metallic nickel in which microparticles of SiC are densely and uniformly dispersed.

The main object of the present invention is to provide an improved device which avoids the above-mentioned disadvantages.

The present invention provides, therefore a device for electrolytic surface treatment of mechanical workpieces, such as cylinders for single-cylinder internal combustion engines, comprising a head and counter-head which can be applied in a liquid-tight manner against respective ends of a vertically-arranged workpiece, an anode arranged to extend along the axis of the workpiece in use, and means for circulating a liquid electrolyte around a closed circuit taking it through the interior of the workpiece, the circulation means including a reservoir spaced from the head and counter-head and a circulation pump, characterised by the fact that:

the head is electrically-conductive to provide the cathode contact for the workpiece, and is fixed in the working plane of a work bench, the counter-head is supported by the work bench in such a way that it can be moved towards and away from the head, means being provided for urging the counter-head axially against the upper end of the work-piece when the latter is resting vertically on the head;

the anode is supported only at one end on the head or the counter-head by an electrically-insulating support plinth, and the head and counter-head have passages for the entry of the electrolyte at one end of the workpiece and the exit fo the electrolyte from the other end of the workpiece.

In particular, the insulating plinth may support the base of the anode on the head, and the anode may have a contact terminal at its upper end whilst the counter-head may have a central contact member for the anode current, which engages the contact terminal when the counter-head is pressed against the workpiece.

In order to accommodate cylinders or other workpieces having different diameters, the part of the head which abuts the workpiece, and the part of the counter-head which exerts pressure on the workpiece, are preferably constituted by replaceable annular members which serve as adaptors. Similarly, in order to accommodate cylinders having different axial lengths, the anode is mounted removably in the head so that it can be replaced with another of different length or different shape.

In an advantageous embodiment, the head is connected to the delivery side of the circulation pump in such a way that the electrolyte passes through the workpiece in an ascending current, the passage for the electrolyte in the head including an upwardly-flared end part which surrounds the anode support plinth coaxially and is free from any irregularities which could impart swirling movements to the electrolyte entering the workpiece during operation of the device. The absence (or at least substantial absence) of swirling movements in the flow of electrolyte passing through the workpiece is particularly important in the case of electrolytes with a dispersion of SiC, since such movements would detrimentally affect the homogeneity of the dispersion.

In a particularly advantageous embodiment, the device according to the invention is in the form of an installation which includes several identical treatment devices as described above, each constituted by a head and counter-head, in which the heads of all the devices are fixed in the working plane while the counter-heads are supported in vertical axial alignment with the associated heads by a common horizontal bracket supported from the work bench, for vertical displacement, by hydraulic cylinders. In this way, with the bracket in the raised position, several workpieces can be placed on the associated heads, after which all of the counter-heads can be simultaneously applied to the workpieces by lowering the bracket to allow the commencement of the electrolytic treatment cycle on all the workpieces simultaneously.

According to the invention, it is preferable for the electrolyte reservoir to be situated below the level of the working plane so that, when the circulation around the circuit is stopped, the electrolyte contained in the workpiece can flow back to the reservoir under gravity. This can be achieved by inserting a solenoid return valve in the electrolyte supply duct, which opens a return path to the reservoir when the respective pump is stopped. The simplest way of realising this object is to utilise a centrifugal pump which, as is known, permits the return flow of liquid under gravity when it is stopped.

A particularly preferred (and complete) embodiment of the device described above is one in which:

a plurality of reservoirs containing different treatment liquids are each connected to the intake side of a respective circulation pump with a delivery side which is connected through a normally-closed control valve to a common distributor which supplies all the heads;

the counter-heads are connected to a common manifold from which respective return ducts branch off to the respective reservoirs, the manifold being provided with a normally-closed control valve for each return duct, and valve control means are provided so that the reservoirs are selectively connectible with the distributor and the manifold to effect circulation of the liquid contained in the selected reservoir through the workpiece.

The invention will now be more particularly described, by way of example, with reference to the accompanying drawings, in which.

Figure 2:
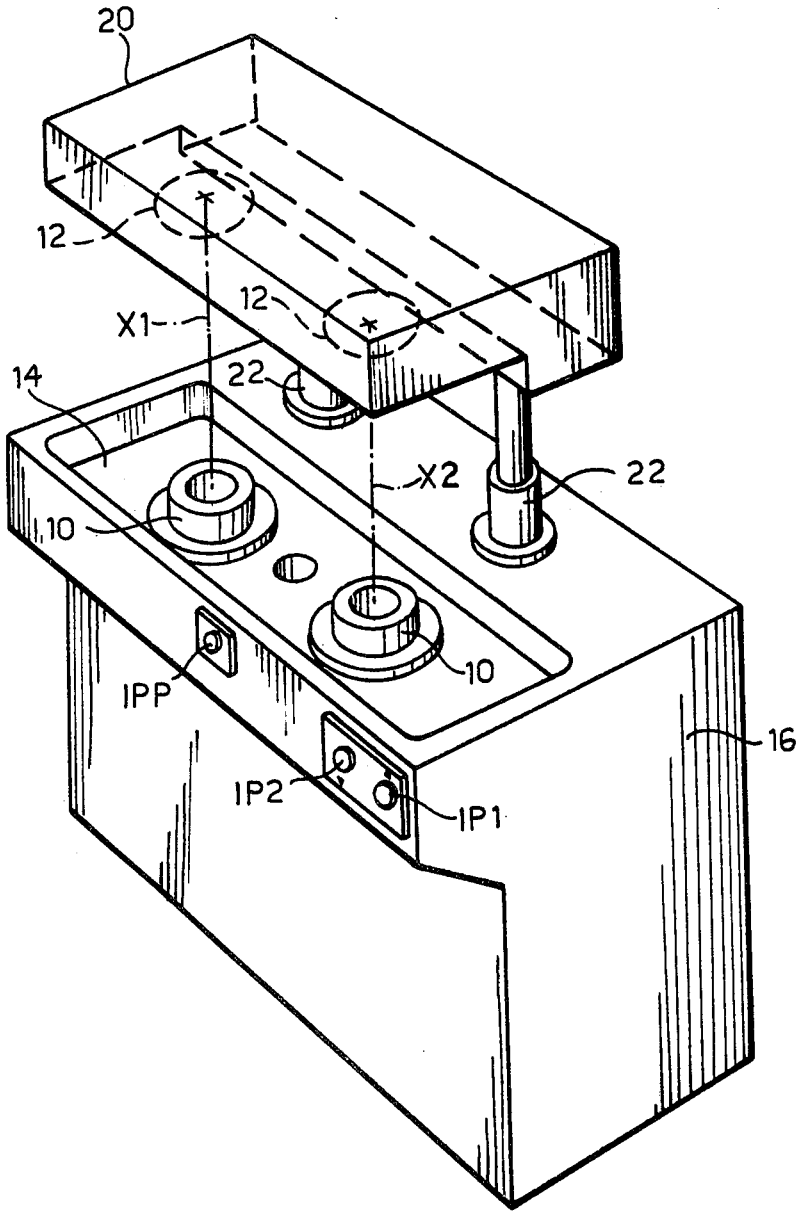
FIG. 2 is a schematic perspective view of a work bench including two devices constructed according to FIG. 1.

In the drawings there are shown two electrolytic surface treatment devices U1, U2 (FIG. 3) each comprising a head 10 and a counter-head 12 which are aligned with one another on respective vertical axes X1, X2 (FIG. 2). It will be appreciated that there may be any number of treatment devices as required.

The heads 10 are mounted in a horizontal plate 14 which constitutes the working plane of a work bench 16. The counter-heads 12 are mounted in a horizontal plate 18 (FIG. 1) constituting the lower wall of a horizontal box bracket 20 (FIG. 2). The bracket 20 is supported on the work bench 16 by a pair of vertical uprights formed by double-acting hydraulic cylinders 22 (FIGS. 2 and 4), so that the bracket 20 is displaceable vertically to raise and lower the counter-heads 12 along their respective axes X1, X2.

Figure 1:
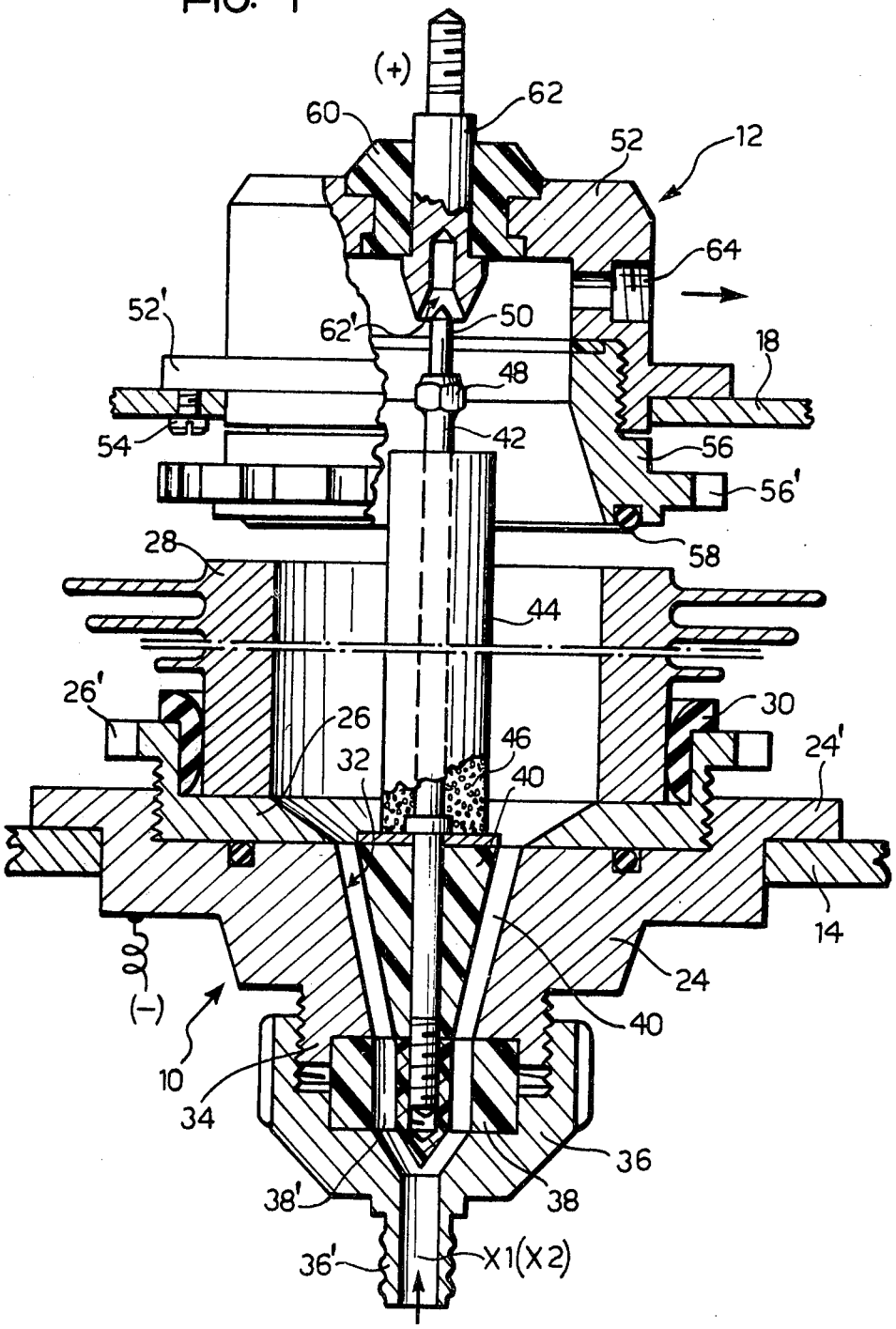
FIG. 1 is a section of an electrolytic surface treatment device according to the present invention, showing its counter-head approaching the working position.

As shown in FIG. 1, each of the heads 10 includes a circular base block 24 which is inserted from above into a corresponding aperture in the plate 14, and has a circumferential flange 24' bolted to the plate. The top of the block 24 has a flat circular cavity into which there is screwed an annular adaptor 26 having a toothed ring nut 26' which allows the adaptor to be screwed by hand or by a suitable key. The adaptor 26 constitutes an abutment for the workpiece to be treated which is constituted, in this case, by a finned cylinder 28 for an internal combustion engine. The cylinder 28 is inserted from above into the adaptor and is centred in the latter by means of a flexible seal 30 which is rigidly connected to the adaptor and sealingly surrounds the lower end of the cylinder 28. Both the adaptor 26 and the block 24 are made of metal, and the block 24 is connected to the negative pole of a source of electrolysing current so that the cylinder 28, once inserted into the adaptor, is also connected to this pole. The adaptor 26 and its seal 30 can be exchanged for another when, at the end of the treatment of a series of cylinders 28 of a given diameter, it is desired to commence treatment of a series of cylinders of different diameter.

The block 24 is traversed centrally by an axial hole 32 of upwarldy-flared, frusto-conical shape in which the vertex angle of the cone is preferably not greater than about 30°. This hole 32 opens at the top within the perimeter of the adaptor 26 whilst at its lower end its opens through a central boss 34 of the block 24 onto which there is screwed, from below, a cap 36 forming an axial coupling 36' for the supply of treatment liquid. Between the cap 36 and the boss 34 there is clamped a thick robust disc 38 of electrically-insulating plastics material, which has a circular array of holes 38' through which the coupling 36' communicates with the peripheral zone of the hole 32.

Into the hole 32 there is coaxially inserted, from above, a frusto-conical plinth 40 of electrically-insulating rigid plastics material, which rests at the bottom on the disc 38 and has substantially the same taper as the hole 32. For correct centering, the plinth 40 preferably has at least three fins 40' which extend along the generatrices of the cone of the plinth and are equidistant from each other. Thus, the final part of the liquid delivery passage through the head 10 is constituted by a frusto-conical tubular channel defined internally by the plinth 40 and externally by the surface of the hole 32. The surfaces which define this passage are smooth and perfectly coaxial, so that the liquid entering the workpiece 28 is free from swirling movements. The fins 40' also contribute to this. The plinth 40 is clamped in the hole 32, against the disc 38, by means of a rigid steel shaft 42 which lies on the axis X1 (or X2) of the head and has its lower end screwed into the centre of the disc 38.

As is known, the shaft 42 forms a part of the anode of the treatment device. The anode further includes a tubular basket 44 of wire gauze, for example of titanium, which is coaxial with the shaft 42 and is held against the plinth 40 at its base by means of a collar on the shaft, as can be seen in FIG. 1. The basket 44 is open upwardly and is filled with pellets 46 of anode material. In the specific case illustrated, in which the cylinder 28 is of aluminium of aluminium alloy and its inner surface must be hardened by means of electrolytic deposits of nickel/silicon carbide, the basket 44 will contain nickel pellets. The basket 44 projects above the cylinder 28, and the shaft 42 extends upwardly beyond the basket to end with a prismatic enlargement 48 (for example, of hexagonal shape) followed by an axial electrical contact point 50. The prismatic enlargement 48 permits unscrewing the shaft 42 for the purpose of replacing the shaft and the basket with others of greater or smaller length in dependence on the axial length of the cylinder 28 to be treated.

Alternatively, in place of the illustrated anode, which is soluble, an insoluble anode may be used, which is constituted by a titanium bar having a shape and external dimension substantially similar to those of the anode assembly illustrated.

The counter-head 12 (FIG. 1) includes a downwardly-facing circular metal cup 52 which is inserted in a corresponding aperture in the plate 18 and bolted to the latter by means of a flange 52' and screws 54. As with the structure of the head 10, the cup 52 is also screwed down onto an annular adaptor 56 with a toothed ring nut 56', for the accommodation of cylinders 28 of different diameters. The adaptor 56 may be made from metal or an insulating material such as plastics, and is provided with a convenient flexible seal 58 for engaging the upper end of the cylinder 28. In the bottom of the cup 52 there is sealingly positioned an insulator 60 which is traversed axially by a contact 62 for supplying the anode current. A frontal seat 62' is formed in the lower end of the contact 62, into which the point 50 of the shaft 42 penetrates when the counter-head 12 is lowered to engage the cylinder 28 under pressure. Thus, in the working position, the electrolysing current is supplied to the anode by the contact 62 carried by the counter-head. The cavity of the cup 52 communicates with the exterior through a radial threaded passage 64 communicating with the return branch of the electrolyte circulation circuit.

Figure 3:
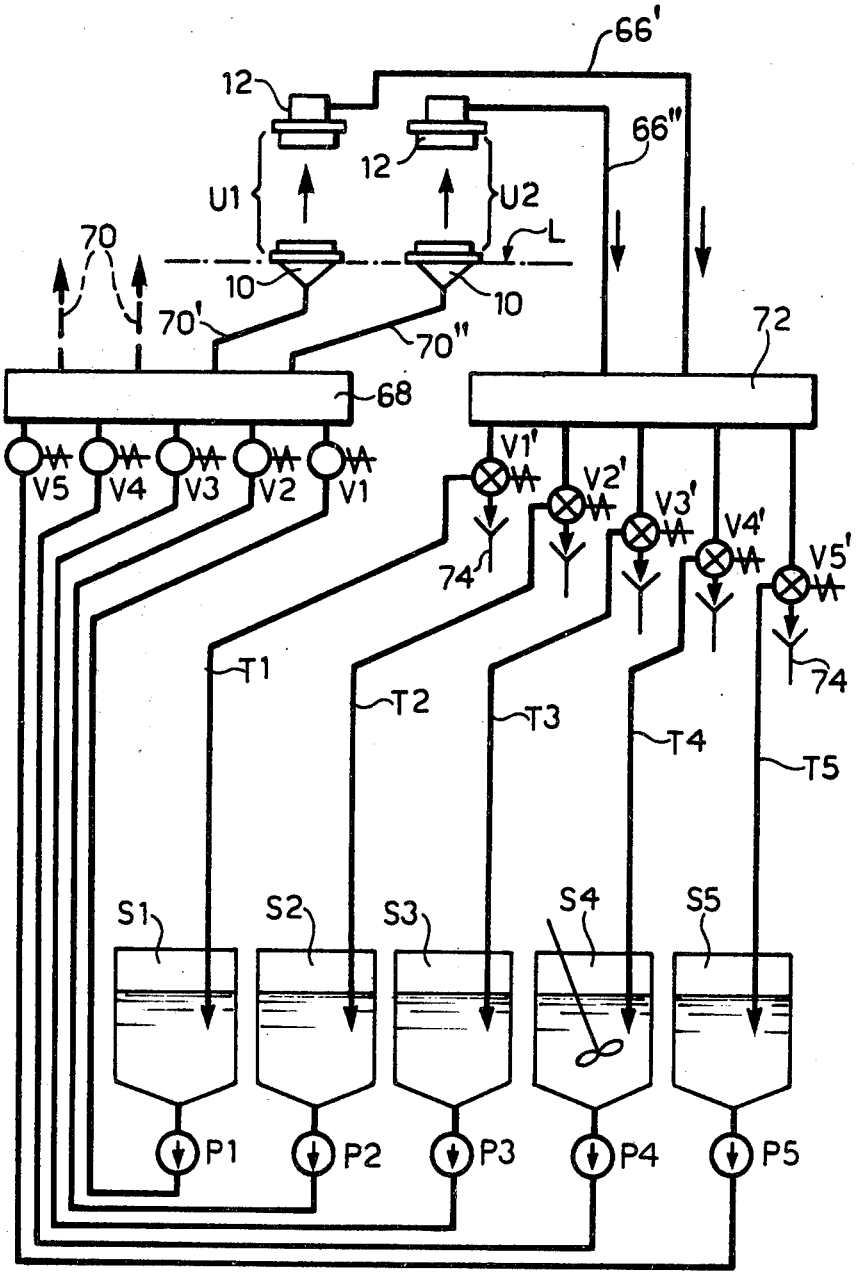
FIG. 3 is a diagram showing the connections of the devices of FIG. 2 with the reservoirs of different treatment liquids.

The lay-out illustrated in FIG. 3 is designed to permit the device of the invention to effect the following treatment cycle (as known per se) to cylinders 28 of aluminium alloy:

(a) attack with a solution of nitric acid ($HNO_3$) and hydrofluoric acid (HF),
(b) washing with water,
(c) activation with a zincate,
(d) washing with water,
(e) second attack with $HNO_3$/HF,
(f) washing with water,
(g) attack with dilute $HNO_3$,
(h) washing with water,
(i) second activation with zincate,
(j) washing with water,
(k) electrodeposition of Ni/SiC,
(l) final washing with water.

The circuit illustrated therefore includes five reservoirs S1, S2, S3, S4, S5 containing the $HNO_3$/HF mixture, the zincate solution, dilute $HNO_3$, the Ni/SiC electrolyte and washing water, respectively. The reservoir S4 containing the Ni/SiC electrolyte is provided with an agitator to maintain the ultra-fine particles (less than one micron) of SiC in suspension. Each of the reservoirs is provided with a respective centrifugal circulation pump P1, P2, P3, P4, P5.

The horizontal line L in FIG. 3 represents the level of the working plane 14 of the work bench 16 (FIG. 2), so as to show clearly which parts of the circuit are situated above and below this level. In particular, it can be seen from FIG. 3 that in practice, with the exception of respective discharge pipes 66', 66'' connected to the counter-heads 12 of the devices U1, U2, all the remaining parts of the circuit lie below the level L, that is, within the work bench 16 of FIG. 2. Moreover, it can be seen that the reservoirs S1, S2, S3, S4, S5 with their respective pumps P1, P2, P3, P4, P5 constitute the lowermost part of the circuit.

The delivery sides of all the pumps are connected to a common distributor 68 through respective normally-closed solenoid control valves V1, V2, V3, V4, V5 situated at the input of the distributor. Once it has been supplied to the distributor through one of the valves V1, V2, V3, V4, V5, the electrolyte is distributed to the heads 10 of the devices U1, U2 through respective pipes 70', 70''. The broken lines 70 indicate the supply pipes of possible additional treatment devices identical to the devices U1, U2, which may be carried by the work bench.

The discharge pipes 66', 66'' open into a manifold 72 having the same number of outputs as there are reservoirs, that is, five in the illustrated case. Each output is constituted by a respective solenoid valve V1', V2', V3', V4', V5', which is normally-closed and has two other positions. In one of these positions, the output of each solenoid valve is connected with its respective reservoir through a respective return pipe T1, T2, T3, T4, T5. In its other position, the output of each solenoid valve is connected with a drain 74, which is intended to include a purifying vessel or other decontamination means.

Figure 4:
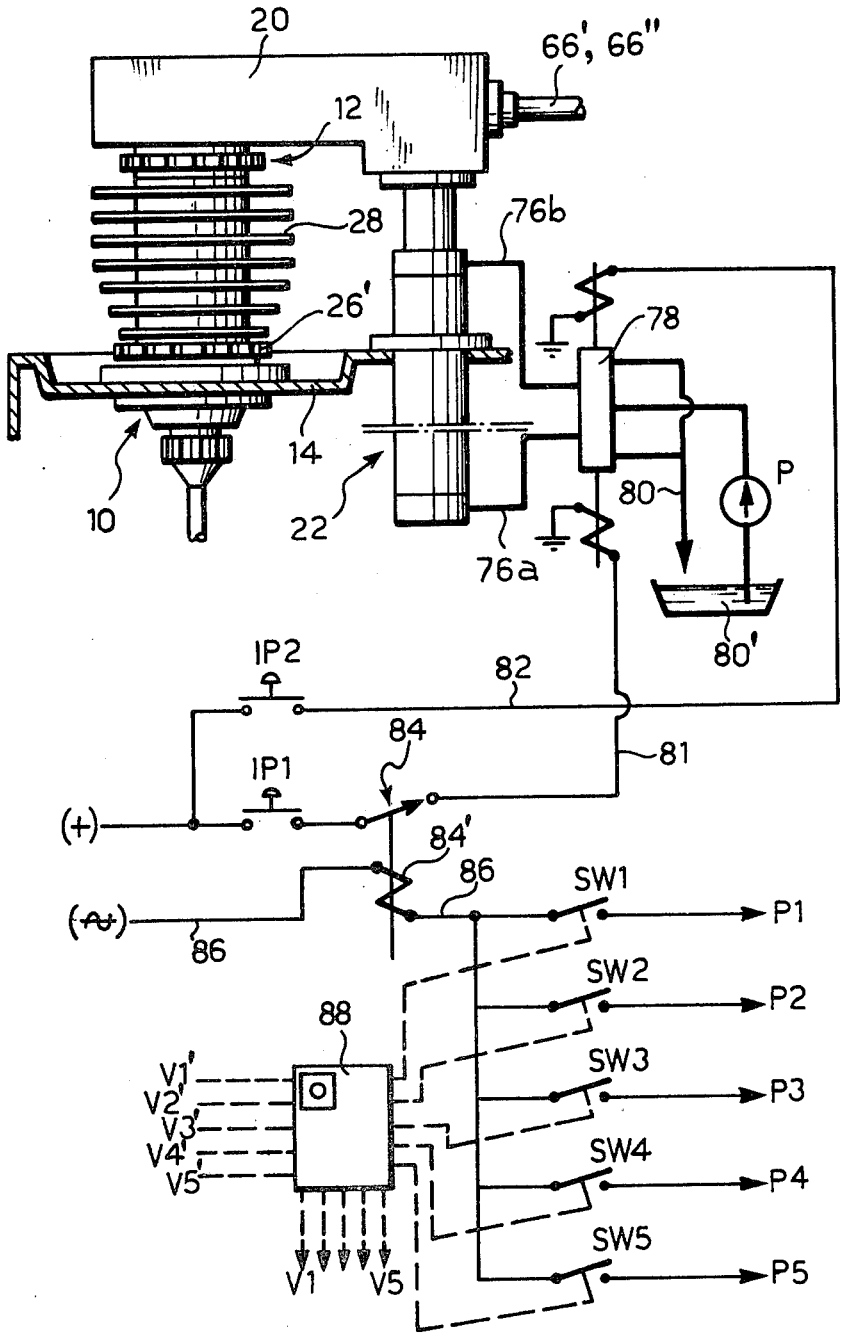
FIG. 4 is a partial side view of the work bench of FIG. 2, on an enlarged scale, showing its hydraulic circuit and a part of its electric control unit.

In FIG. 4, the ends of each hydraulic cylinder 22 communicate through a rising duct **76*a* and a lowering duct 76*b* with a normally-closed solenoid valve 78 having two other positions. In one of these positions, the valve 78 connects the raising duct 76*a* with the hydraulic fluid pump P and the lowering duct 76*b* with a duct 80 which returns the hydraulic fluid back to a reservoir 80', thus causing bracket 20 to rise with the counter-heads 12 of the treatment devices U1, U2. In its other position, the valve 78 reverses the connections described above to lower the bracket 20 and to press the counter-heads 12 against the upper ends of the respective cylinders 28 to be treated. For the raising operation, the solenoid valve 78 is controlled by a push-button switch IP1 through a conductor 81 and, for lowering, the valve 78 is controlled by a push-button switch IP2 through a conductor 82. The switches IP1 IP2 are also shown in FIG. 2**.

Downstream from the raising switch IP1, in the conductor 81, there is connected a normally-closed relay 84 having its excitation winding 84' connected to an energising conductor 86 for the pumps P1, P2, P3, P4, P5 which are connected to this conductor through respective switches SW1, SW2, SW3, SW4, SW5. These switches may be manually operated, but it is preferable to provide the work bench 16 with a programmer-timer unit 88 (FIG. 4) for the automatic control of the treatment cycle. The programmer-timer 88 is constructed in such a way as to control all of the solenoid valves and the pumps in the circuit of FIG. 3 at programmable times and for programmable durations. It may be seen from FIG. 4, that, when any of the pumps P1, P2, P3, P4, P5 is switched on, the relay 84 is open and prevents the raising of the bracket 20 by the push-button switch IP1.

With reference to the treatment cycle comprising stages (a) to (l) described above, the device operates as follows.

By pressing the push-button IP1 the operator raises the bracket 20 and then positions the cylinders 28 to be treated on the heads 10, after which the bracket 20 is lowered by pressing the push-button IP2, so that the cylinders 28 are pressed axially against the respective abutment seats formed by the adaptors 26 (FIG. 1) by the counter-heads 12, and the interiors of the cylinders 28 are isolated from the external environment by the seals 30, 58. The energising circuit for the washing pump P5 and its respective solenoid valves V5, V5' includes a test button IPP (FIG. 2), which the operator can press to perform a preliminary check on whether the cylinders 28 on the work bench are closed and sealed correctly by the respective seals.

If there are any sealing defects, the spray or jet of water from issuing from the point of failure indicates the defect without the risk of burning as would be the case, for example, with a jet of $HNO_3$/HF which would be present upon commencement of stage (a) of the process. When the test button IPP is released, the water which fills the cylinder and the various parts of the circulation circuit returns under gravity to the reservoir S5, the valves V5, V5' being kept open for a certain time after the pump P5 has been switched off. The means necessary for this purpose are well known and a description thereof would be superfluous.

At this point, the programmer 88 is switched in and, to perform stage (a) of the process, opens the valves V1, V1' and closes the switch SW1 of the pump P1, causing the nitric and hydrofluoric acid for attacking the inner surface of the cylinder 28 to circulate through the cylinder 28 in a closed circuit. After a predetermined time, the programmer first switches off the pump P1 but delays the closure of the valves V1, V1' to permit the attacking acid to flow out under gravity to the reservoir P1. Stage (a) is thus terminated.

For the washing stage (b), the programmer 88 opens the valve V5, closes the switch SW5 of the pump P5, and commutes all the valves V1', V2', V3', V4', V5' to the position where they discharge to the drain 74. Thus, water drawn by the pump P5 from the reservoir S5 washes the interior of the distributor 68, the ducts 70', 70'', the heads 10, the cylinders 28, the counter-heads 12, the ducts 66', 66'', the manifold 72 and the valves V1', V2', V3', V4' V5' until all the residues from the acid attack of stage (a) have been completely removed. Having done this, the programmer 88 switches off the pump P5 but still leaves the valves V1 and V1', V2', V3', V4' V5' open, to permit the water to flow back under gravity to the reservoir S5 (through the valve V1) and to the drain 74 (through the valves V1', V2', V3', V4', V5'), after which these valves are de-energised to return to the closed position.

The subsequent treatment stages (c), (e), (g), (i), (k), and the washing stages (d), (f), (h), (j), (l), are performed in a similar manner to the treatment stage (a), and washing stage (b) described above, through the control of associated valves and pumps by the programmer 88. Only in stage (k), the electrodeposition of Ni/SiC, does the programmer also respectively connect and disconnect the electrolysing current at the commencement and at the termination of this stage.

At the end of the treatment process, which the programmer may indicate by an optical and/or acoustic signal, the pumps P1, P2, P3, P4, P5 are switched off, so that the operator can raise the bracket 20 by pressing the push button IP1, remove the treated cylinders 28 and load new cylinders to be treated. At this time the anode basket 44 can also be refilled with a certain quantity of small pellets or granules of nickel to replace those consumed during the electrolytic deposition.

What is claimed is:

1. A device for electrolytic surface treatment of mechanical workpieces, including a head and a counter-head, respective support means for the head and counter-head, the head and counter-head having respective parts which can be applied in a liquid-tight manner against respective ends of a said workpiece arranged vertically, an anode arranged to extend along the axis of said workpiece in use, and means for circulating a liquid electrolyte around a closed circuit taking it through the interior of said workpiece, said circulation means including a reservoir spaced from the head and counter-head and a circulation pump, wherein the improvement consists in:

the head being electrically-conductive to provide a cathode contact for said workpiece, and being mounted fixedly in a working plane by its said support means;

the counter-head being supported by its said support means in such a way as to be movable towards and away from the head;

means being provided to urge the counter-head axially against the upper end of said workpiece when the latter is resting vertically on the head;

electrically-insulating means supporting the base of said anode on the head, the anode having a contact terminal at its upper end, and the counter-head having a central anode current contact member engaging the said contact terminal when the counter-head is pressed against the workpiece, and the head and the counter-head defining respective passages for the entry of said electrolyte at one end of the workpiece and the exit of the electrolyte from the other end of the workpiece.

2. A device as defined in claim 1, wherein said part of the head which supports the workpiece, and said part of the counter-head which abuts the workpiece, are constituted by respective replaceable annular members.

3. A device according to claim 1 wherein said anode is one of a replaceable series of anodes of different lengths.

4. A device according to claim 1, wherein the head is connected to the delivery side of said circulation pump so that the electrolyte passes through the workpiece in an ascending current, and wherein said passage defined by the head includes an upwardly-flared end part which surrounds said electrically insulating means coaxially and is free from irregularities so as to prevent the imparting of swirling movements to the electrolyte entering the workpiece during operation of the device.

5. A device according to claim 1, wherein said electrolyte reservoir is situated below the level of said working plane so that, when the circulation of electrolyte is stopped, the electrolyte in the workpiece flows back to the reservoir under gravity.

6. An installation including a plurality of devices each in accordance with claim 1, and further including a work bench constituting said support means for the heads, a horizontal bracket constituting said support means for the counter-heads and being supported by said work bench so that the counter-heads are in vertical axial alignment with their associated heads, and hydraulic cylinders supporting said bracket on said work bench for vertical displacement whereby the counter-heads are urged against respective workpieces resting on the heads.

7. An installation according to claim 6, further including:

a plurality of reservoirs and a corresponding plurality of circulation pumps, said reservoirs containing different treatment liquids, and each said reservoir being connected to the intake side of a respective said circulation pump;

a common distributor connected to the delivery side of each said pump, said distributor supplying the liquids to the heads;

a respective normally-closed control valve interposed in the connection between each pump delivery side and said distributor;

a common manifold connected to the counter-heads;

a respective return duct connecting said manifold to each reservoir;

a respective normally-closed control valve provided in the manifold for each return duct, and valve control means for selectively connecting each said reservoir to the distributor and the manifold, whereby the liquid contained in the selected reservoir is circulated through the workpiece.

* * * * *